US005153896A

United States Patent [19]

Hamy et al.

[11] Patent Number: 5,153,896

[45] Date of Patent: Oct. 6, 1992

[54] METALLURGICAL VESSEL EQUIPPED WITH AT LEAST ONE ELECTRODE PASSING THROUGH ITS WALL

[75] Inventors: Michel Hamy, Strasbourg; Christian Lebrun; Jean-Michel Thébault, both of Valenciennes; Ghislain Maurer, Chatel Saint Germain; Philippe Destannes, Metz, all of France

[73] Assignee: IRSID, Puteaux, France

[21] Appl. No.: 652,625

[22] Filed: Feb. 8, 1991

[30] Foreign Application Priority Data

Feb. 9, 1990 [FR] France ..... 90 01640

[51] Int. Cl.[5] ..... H05B 7/12

[52] U.S. Cl. ..... 373/95; 373/94; 373/96; 373/69; 373/36; 373/37; 373/38; 373/72

[58] Field of Search ..... 373/95, 94, 96, 98, 373/72, 67, 69, 83, 80, 88, 90, 100, 101, 36, 37, 38, 51, 52, 54, 55

[56] References Cited

U.S. PATENT DOCUMENTS 1,715,376 6/1929 McLaughlin ..... 373/95
4,457,002 6/1984 Mathgen et al. ..... 373/95
4,715,041 12/1987 Buhler et al. ..... 373/72
4,720,838 1/1988 Guido ..... 373/72
4,982,411 1/1991 Micheket et al. ..... 373/72

*Primary Examiner*—Bruce A. Reynolds
*Assistant Examiner*—Tu Hoang
*Attorney, Agent, or Firm*—Pollock, Vande Sande & Priddy

[57] ABSTRACT

The metallurgical vessel, such as a direct-current arc furnace, comprises a metal housing (1) lined on its inside with refractory material (2), at least one electrode (3) passing through the bottom of the vessel and connected to a terminal of an electrical power supply, the electrode being fastened to the metal housing by a mechanical fastening arrangement and insulated electrically from the housing. A leaktight wall (20) surrounding the fastening zone of the electrode prevents a liquid flowing over the inner surface of the housing from coming into contact with the electrode fastening arrangement, and orifices (26) are provided for discharging the liquid collected out of the housing. The invention is particularly applicable to direct-current arc furnaces and prevents the molten lead originating from the scrap metal of the charge and infiltrating through the refractory from damaging the electrical insulation of the fastening of the electrode.

8 Claims, 2 Drawing Sheets

METALLURGICAL VESSEL EQUIPPED WITH AT LEAST ONE ELECTRODE PASSING THROUGH ITS WALL

FIELD OF THE INVENTION

The present invention relates to a metallurgical vessel intended to contain a bath of molten metal and equipped with at least one electrode passing through the bottom wall of the vessel. Such vessels, for example direct-current arc furnaces for melting steel, comprise a metal housing and an inner lining of refractory material. At least one electrode, referred to as the hearth electrode, passes through the bottom of the housing and the refractory lining, and it is flush with the inner surface thereof in order to be in electrical contact with the bath of metal contained in the vessel during use.

This electrode, connected to a terminal of a current source, is generally fastened mechanically on the housing by a fastening device supporting the electrode and held on the housing, for example by bolts. In order to prevent the housing reaching the potential of the electrode, electrically insulating elements are placed between the housing and the fastening device which is in electrical contact with the electrode.

During use, for melting scrap metal and producing steel, of direct-current arc furnaces comprising such a hearth electrode, defects in the electrical insulation may give rise to electrical flashover phenomena between the hearth electrode or its fastening means and the metal housing, causing stoppages in production which are required to reset the characteristics of the electrical insulator, this resetting operation generally requiring removal of the fastening device in order to install a new insulator.

SUMMARY OF THE INVENTION

It is an object of the present invention to solve these problems and to prevent these electrical flashover phenomena, or at least to considerably reduce their frequency.

With these objects in view, the subject of the invention is a metallurgical vessel such as a direct-current arc furnace, comprising a metal housing lined on the inside with refractory material and at least one electrode passing through the bottom of the vessel and connected to a terminal of an electrical power supply, the electrode being fastened to the metal housing by mechanical fastening means and insulated electrically from the housing.

According to the invention, the vessel comprises a leaktight wall surrounding the fastening zone of the electrode, extending towards the inside of the housing and connected to the latter in a leaktight manner, this wall forming a retention means which prevents a liquid flowing over the inner surface of the housing from coming into contact with the said fastening means of the electrode and/or with the electrode itself.

In fact, it has been observed that, in prior art installations, the problems of electrical flashover phenomena were due, in particular, to the flow over the surface of the housing of molten heavy metals, such as lead, which, coming into contact with the fastening means of the electrode to the housing, interfere with the electrical insulation of the latter. More precisely, the lead contained in the charge of scrap metal introduced into the furnace melts during operation of the latter. The density of the lead and its fluidity at the high temperatures prevailing in the chamber of the furnace are such that the molten lead is able to pass through the refractory lining of the furnace.

Its relatively low melting point means that, even upon contact with the metal wall of the housing, the lead remains liquid and flows over the inner surface of the housing towards the lowest point thereof. It can thus enter into contact with the fastening means of the electrodes and break the electrical insulation of the latter either by coming into contact with the metal elements of the fastening means, or even by infiltrating into the electrical insulator and damaging it or harming its insulating properties.

Moreover, as the fastening means of the electrode are commonly cooled, they have a temperature which is lower than the solidification temperature of the lead and, when the molten lead comes into contact therewith, it solidifies and forms a permanent electrical connection between the electrode and the housing.

The present invention makes it possible to prevent the molten lead flowing over the inner surface of the housing from reaching the fastening means of the electrode or electrodes, and thus prevents breakage of their electrical insulation.

According to a particular arrangement of the invention, the said retention means preventing the contact of a liquid flowing inside the housing with the fastening means of the electrode comprise a leaktight wall surrounding the fastening zone of the electrode, extending towards the inside of the housing and connected to the latter in a leaktight manner, discharge means being provided for collecting and discharging the liquid out of the housing.

These discharge means preferably comprise at least one orifice passing through the housing and located at the periphery of the said leaktight wall forming a retention means.

By virtue of these arrangements, the molten lead flowing over the inner surface of the housing is collected at the lowest point of the latter outside the wall surrounding the electrode and thus cannot reach the fastening means of the electrode. The orifice made in the housing makes it possible to discharge the molten lead which flows via this orifice and is recovered by a collector. In this way, the accumulation of molten lead around the retention wall is avoided, as is the risk of its flowing over the top of the said wall.

Moreover, this wall, which is connected to the housing, is at a temperature which is sufficient to prevent solidification of the lead in contact therewith, thus, as a consequence, preventing blockage of the discharge orifice.

The retention wall may consist simply of the edge of an intermediate small plate fastened on the inside of the housing, and of a thickness which is sufficient to form the retention means for the molten lead at its periphery. In this case, the electrode is fastened on this intermediate small plate on the side located towards the outside of the furnace, and is electrically insulated therefrom.

The upper surface of this intermediate small plate, which the electrode traverses without contact, advantageously slopes towards its periphery, making it possible to collect the molten lead passing through the refractory located above the small plate and to cause it to flow into the retention means formed by its periphery.

BRIEF DESCRIPTION OF THE DRAWINGS

Other characteristics and advantages will emerge from the description which will be given of an embodiment of the invention in the case of a direct-current arc furnace for melting ferriferous materials and producing liquid steel with reference to the appended drawings, in which.

DETAILED DESCRIPTION

Figure 1:
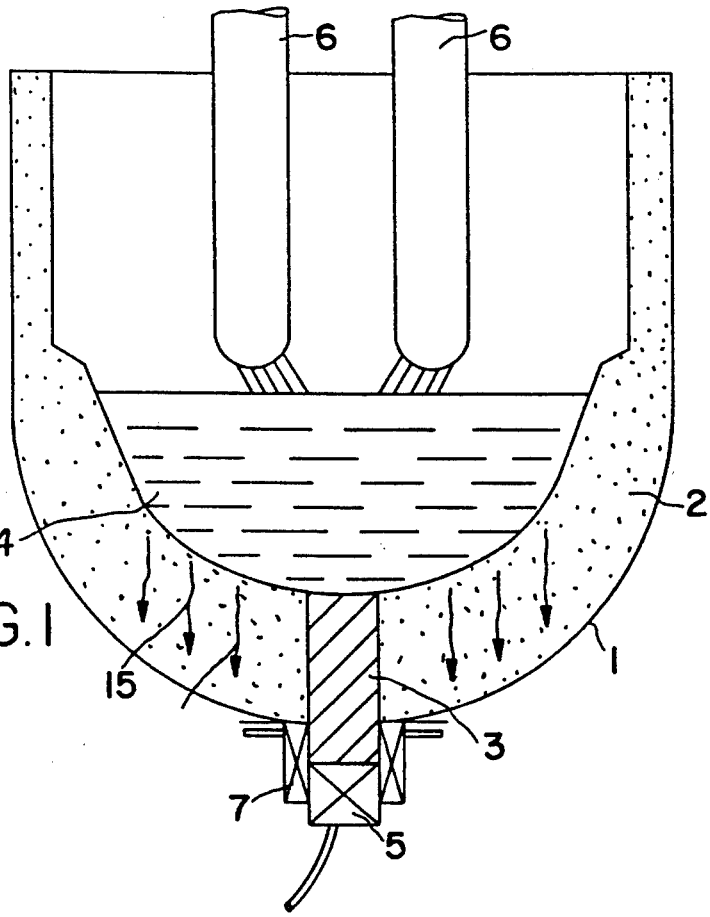
FIG. 1 is a schematic section view of such an arc furnace, equipped with a hearth electrode, according to the prior art.

The furnace shown in FIG. 1 comprises a metal housing 1 lined on the inside with a refractory material 2. The bottom of the furnace has a hearth electrode 3 passing through it, which electrode is flush with the inner surface of the refractory lining so as to be in contact with a bath of liquid metal 4 resulting from the melting of scrap metal previously introduced into the furnace. The hearth electrode 3 is connected by a connector device 5 to a terminal of an electrical power supply (not shown), the other terminal of this power supply being connected to at least one roof electrode 6. Such an arrangement is well known in the field of direct-current arc furnaces.

Figure 2:
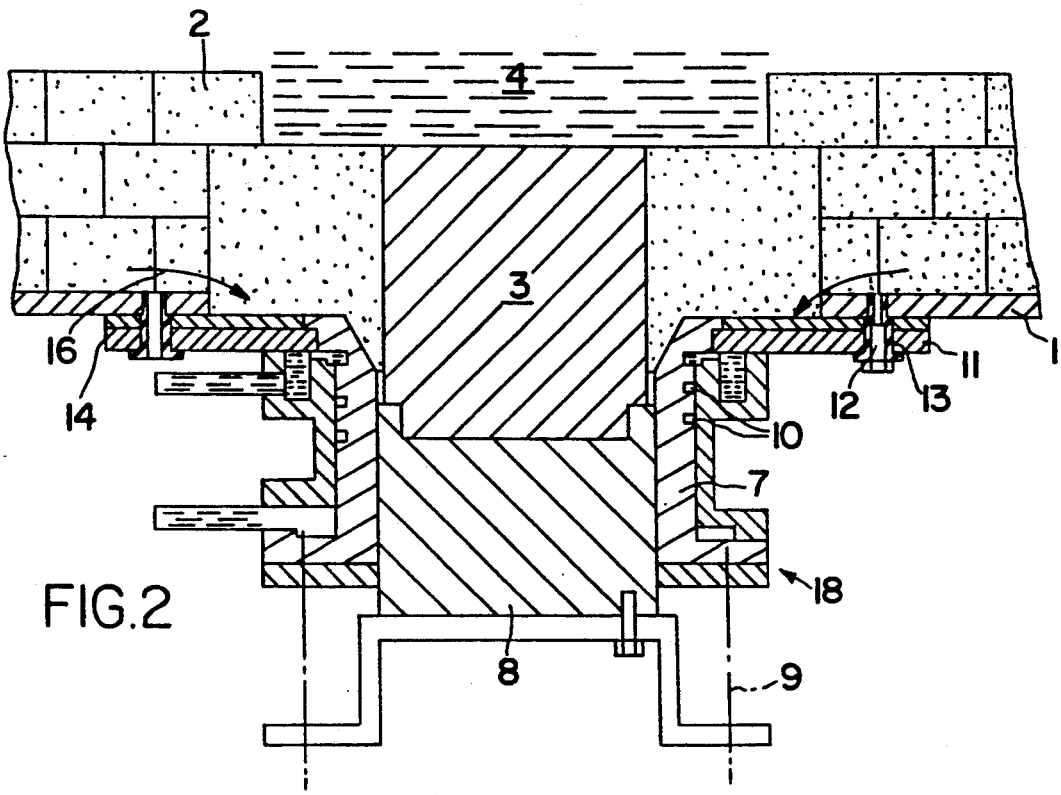
FIG. 2 is a detail view of the fastening zone of the hearth electrode of this furnace.

A conventional way of fastening the hearth electrode to the furnace, described, in particular, in FR 2566984, is shown in FIG. 2. The fastening device 18 of the hearth electrode 3 comprises a sleeve 7 surrounding a cooled nipple 8 supporting the electrode 3. The nipple 8 is held on the sleeve 7 by tie rods shown by means of their axes 9. The sleeve 7 is also cooled by the internal circulation of a cooling fluid, such as water, in channels 10.

The sleeve 7 is made integral, for example by welding, with a flange 11 fastened to the housing 1 on the outside of the latter by means of screws 12, this arrangement being provided in order to permit easy removal of the whole fastening device of the electrode.

In order to ensure the electrical insulation of the housing relative to the hearth electrode and its fastening device, a plate 14 of insulating material is inserted between the flange 11 and the housing 1 and insulating washers and bushes 13 electrically insulate the screws 12 from the flange 11.

Electrical flashover phenomena and those of damage to the insulation referred to at the beginning of this specification have arisen particularly in furnaces equipped with hearth electrode fastening devices of the type described above or of similar types.

In fact, the scrap metal which forms the charge introduced into the furnace and melted during operation of the furnace can contain lead. Because of its density and its fluidity at high temperatures, the molten lead infiltrates the refractory lining 2 in the direction of the arrows 15 and, having arrived in contact with the housing 1, flows over its inner surface towards the lowest point of the latter.

It is thus collected near the hearth electrode, in the direction of the arrows 16 in FIG. 2, where it destroys the electrical insulation by permitting the passage of the current between the fastening device of the electrode and the housing. Moreover, since it is in a zone which is colder due to the proximity of the electrode and its sleeve, which are cooled, the lead can solidify and accumulate in this zone, which gives rise to the formation of a stable electrical link.

DESCRIPTION OF THE PREFERRED EMBODIMENTS

Figure 3:
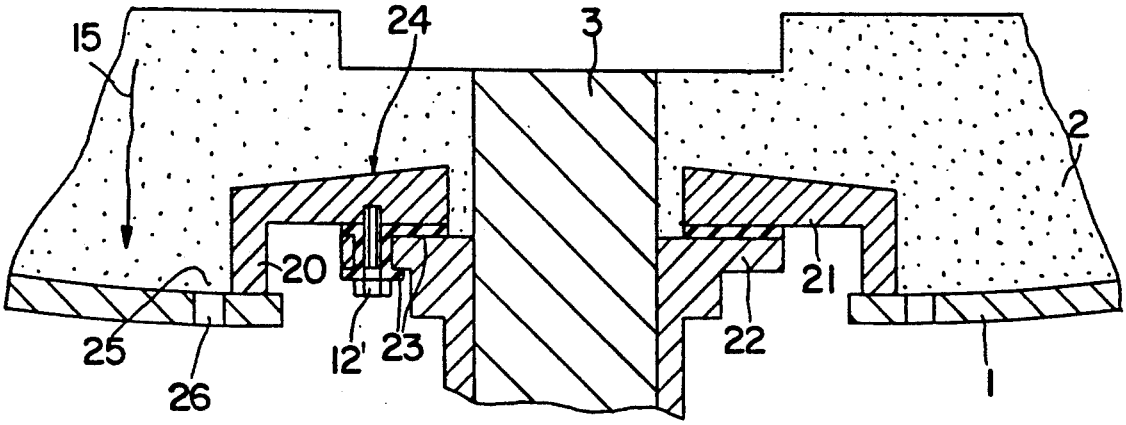
FIG. 3 is a schematic detail view corresponding to an embodiment according to the invention.

Following these references explaining the drawbacks of furnaces according to the prior art, a description will now be given, in connection with FIG. 3, of a preferred embodiment of the invention which makes it possible to solve these problems.

To this end, the furnace comprises a continuous leaktight wall 20, around the hearth electrode 3, which extends upwards from the housing 1 to which it is welded. In the example shown, this wall 20 is integral with an intermediate small plate 21 which is raised relative to the bottom of the housing. The fastening flange 22 of the electrode is fastened to this small plate in a manner similar to the direct connection on the housing used in the prior art, by means of screws 12', with an electrical insulator 23 inserted between the screws 12' and the intermediate small plate 21, on the one hand, and the flange 22, on the other hand.

Thus, the flow of liquid lead over the bottom of the housing 1 towards the electrode 3 is prevented by the retention means formed by the wall 20 and, moreover, the lead which infiltrates through the refractory located over the intermediate small plate 21 is collected by the latter and directed towards the lowest point 25 of the housing around the wall 20. All the lead collected at this low point can flow out of the housing via orifices 26 provided for this purpose in the metal housing 1 at the periphery of the wall 20.

A particular advantage of the adaptation of the furnace according to the invention is that the fastening zone of the electrode to the furnace is raised relative to the low point of the housing, which further reduces the risks of infiltration of lead into this zone, even when the furnace is tilted for removal of slag or for pouring the molten metal.

Yet a further advantage is that the low point for collecting the lead is distanced from the cold zone near the electrode and its support, which makes it possible to maintain the temperature of this low point above the solidification temperature of the lead and thus prevents solidification of the latter inside the housing.

The invention is not limited to the arrangement which has just been described by way of example.

In particular, in order to improve the electrical insulation, an electrical insulation element could be inserted either between the small plate 21 and the wall 20 if they are separate, or between the wall 20 and the housing 1, or the wall 20 itself could be produced from an insulating material, the assembly of these components on the housing then consequently being performed so as to preserve their leaktightness and the desired electrical insulation.

The small intermediate plate 21 may also rest directly on the bottom of the housing, its thickness then being made sufficient for the edge of this small plate to be high enough to form the retention means for the lead.

The invention has been described above with reference to a direct-current arc furnace comprising a single hearth electrode. It can also be applied to metallurgical vessels comprising several electrodes. In this case, either a retention wall surrounds all the electrodes or each electrode is surrounded by an individual retention wall, it then being possible for the discharge orifice or orifices to be made only at the lowest point of the housing.

The fastening and electrical insulation means of the electrodes described above may also be modified or replaced by an equivalent technological arrangement.

We claim:

1. A metallurgical vessel comprising a metal housing having an interior lined with refractory material and at least one electrode passing through a bottom of said vessel and connected to a terminal of an electrical power supply, said electrode being fastened to said metal housing by mechanical fastening means and insulated electrically from said metal housing, said vessel comprising retention means having a leaktight wall surrounding a fastening zone of said electrode for preventing a liquid flowing through said refractory material of said housing from coming into contact with said fastening means of said electrode.

2. The vessel as claimed in claim 1, said leaktight wall extending towards the interior of said metal housing and connected to said metal housing in a leaktight manner, discharge means being provided for collecting and discharging said liquid out of the housing.

3. The vessel as claimed in claim 2, wherein said discharge means comprise at least one orifice passing through said metal housing and located at a periphery of said leaktight wall.

4. The vessel as claimed in claim 2, wherein said leaktight wall carries an intermediate small plate which is raised relative to a bottom of said metal housing and to which a flange for holding said electrode is fastened.

5. The vessel as claimed in claim 4, wherein an upper surface of said intermediate small plate is inclined towards a periphery of said small plate.

6. The vessel as claimed in claim 4, wherein said intermediate small plate is insulated electrically from said metal housing.

7. The vessel as claimed in claim 1, constituted by a direct current arc furnace.

8. A metallurgical vessel comprising a metal housing having an interior lined with refractory material and at least one electrode passing through a bottom of said vessel and connected to a terminal of an electrical power supply, said electrode being fastened to said metal housing by mechanical fastening means and insulated electrically from said metal housing, said vessel comprising a leaktight wall surrounding a fastening zone of said electrode, extending towards an inside of said metal housing and connected to said metal housing in a leaktight manner.

* * * * *